US011457674B1

(12) United States Patent
Tolefree

(10) Patent No.: US 11,457,674 B1
(45) Date of Patent: Oct. 4, 2022

(54) VEST WITH ILLUMINATION SYSTEM

(71) Applicant: Ricky Tolefree, Stone Mountain, GA (US)

(72) Inventor: Ricky Tolefree, Stone Mountain, GA (US)

( * ) Notice: Subject to any disclaimer, the term of this patent is extended or adjusted under 35 U.S.C. 154(b) by 92 days.

(21) Appl. No.: 17/020,943

(22) Filed: Sep. 15, 2020

(51) Int. Cl.

| | |
|---|---|
| ***A41D 13/01*** | (2006.01) |
| ***A41D 1/04*** | (2006.01) |
| ***F21V 33/00*** | (2006.01) |
| ***A41D 1/00*** | (2018.01) |

(52) U.S. Cl.
CPC ..... *A41D 13/01* (2013.01); *A41D 1/002* (2013.01); *A41D 1/04* (2013.01); *F21V 33/0008* (2013.01); *A41D 2300/50* (2013.01)

(58) Field of Classification Search
CPC .... A41D 13/01; A41D 1/002; A41D 2300/50; A41D 1/04; F21V 33/0008
See application file for complete search history.

(56) References Cited

U.S. PATENT DOCUMENTS

| | | | | |
|---|---|---|---|---|
| D249,197 | S | 9/1978 | Szoke | |
| D259,146 | S | 5/1981 | Carr, Jr. | |
| 5,690,411 | A | 11/1997 | Jackman | |
| 6,267,482 | B1 | 7/2001 | Miller | |
| 6,517,214 | B1 | 2/2003 | Mitchell | |
| 8,449,133 | B2 | 5/2013 | Winzer | |
| D802,845 | S | 11/2017 | Blackwell | |
| 2006/0034064 | A1 | 2/2006 | Kanzler | |
| 2010/0313328 | A1 | 12/2010 | Shelton | |
| 2014/0055986 | A1 | 2/2014 | Corpus | |
| 2019/0037934 | A1* | 2/2019 | Swank | G08B 5/004 |
| 2020/0198675 | A1* | 6/2020 | Preston | H04N 5/33 |
| 2020/0315269 | A1* | 10/2020 | Roberts | A41D 13/01 |
| 2021/0068477 | A1* | 3/2021 | Johnson | A41D 1/002 |

FOREIGN PATENT DOCUMENTS

| | | | | |
|---|---|---|---|---|
| CN | 101927818 A | * | 12/2010 | B63C 9/20 |
| CN | 106937765 A | * | 7/2017 | A41D 13/01 |
| DE | 202017006360 U1 | * | 5/2018 | A41D 13/01 |

* cited by examiner

*Primary Examiner* — Alan B Cariaso

(57) ABSTRACT

The vest with illumination system is a garment. The vest with illumination system is an illuminated structure. The vest with illumination system is a supervised garment. The vest with illumination system includes a vest and a control circuit. The control circuit installs in the vest. The vest is worn by a client. The control circuit generates the illumination of the garment. The control circuit communicates the GPS coordinates of the control circuit to the appropriate authority.

16 Claims, 6 Drawing Sheets

VEST WITH ILLUMINATION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wearing apparel including outerwear and protective garments, more specifically, a protective garments with reflective or luminous safety means. (A41D13/01)

SUMMARY OF INVENTION

The vest with illumination system is a garment. The vest with illumination system is an illuminated structure. The vest with illumination system is a supervised garment. By supervised garment is meant that the GPS coordinates of the vest with illumination system is monitored by an appropriate authority. The vest with illumination system comprises a vest and a control circuit. The control circuit installs in the vest. The vest is worn by a client. The control circuit generates the illumination of the garment. The control circuit communicates the GPS coordinates of the control circuit to the appropriate authority. The control circuit is an independently powered electric circuit. By independently powered is meant that the control circuit can operate without an electrical connection to an external power source.

These together with additional objects, features and advantages of the vest with illumination system will be readily apparent to those of ordinary skill in the art upon reading the following detailed description of the presently preferred, but nonetheless illustrative, embodiments when taken in conjunction with the accompanying drawings.

In this respect, before explaining the current embodiments of the vest with illumination system in detail, it is to be understood that the vest with illumination system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vest with illumination system.

It is therefore important that the claims be regarded as including such equivalent construction insofar as they do not depart from the spirit and scope of the vest with illumination system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
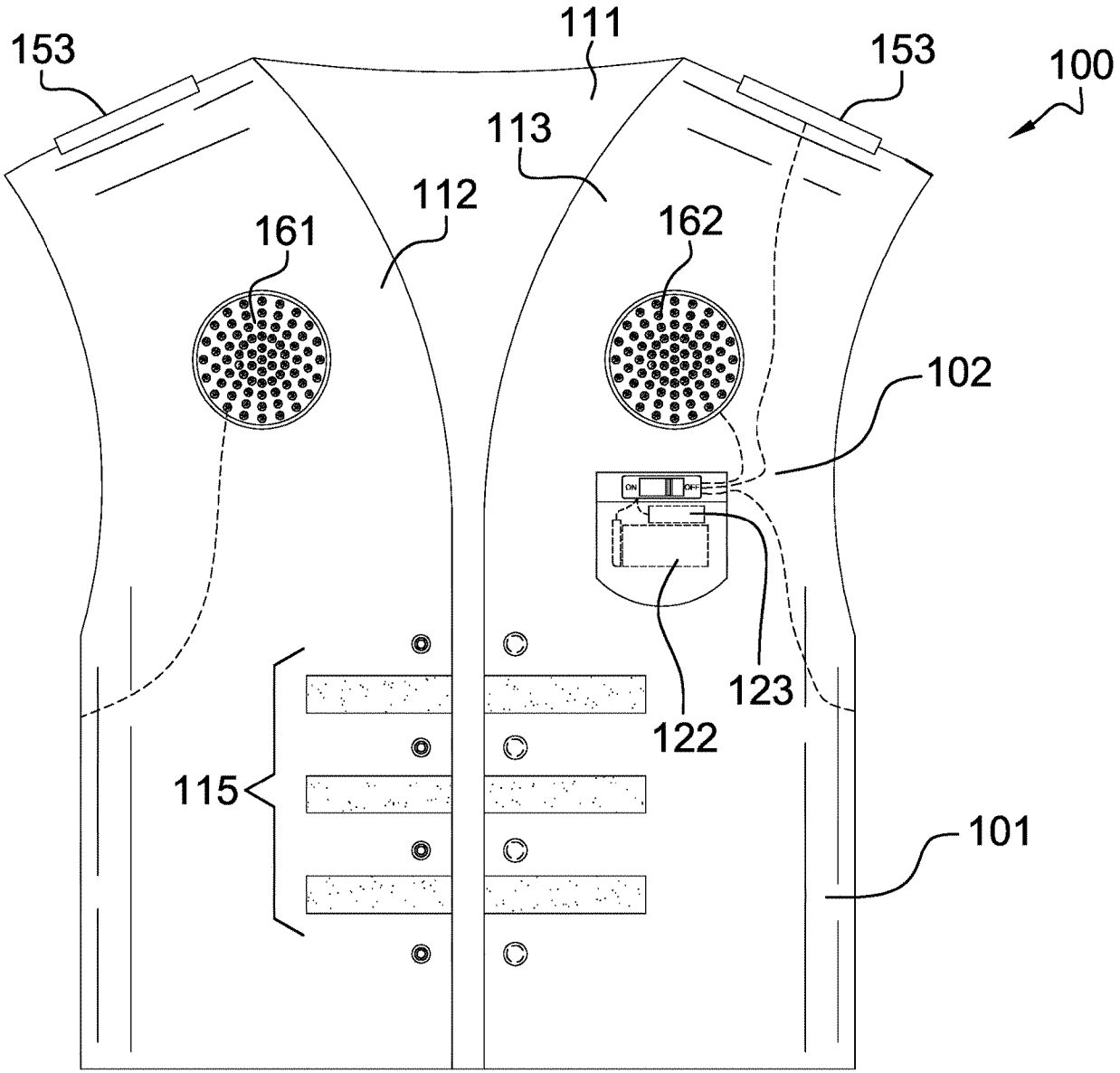
FIG. 1 is a front view of an embodiment of the disclosure.
Figure 2:
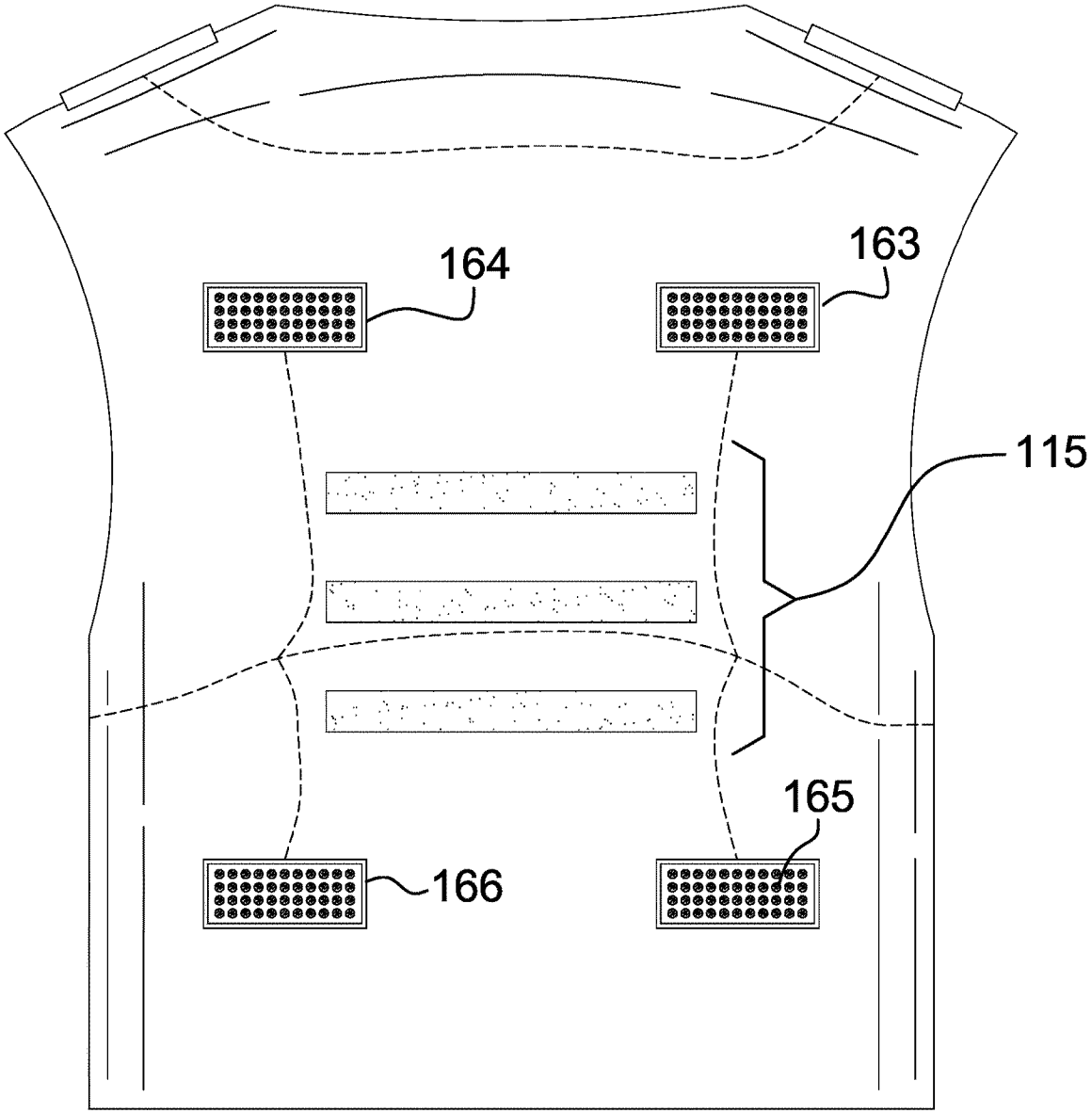
FIG. 2 is a rear view of an embodiment of the disclosure.
Figure 4:
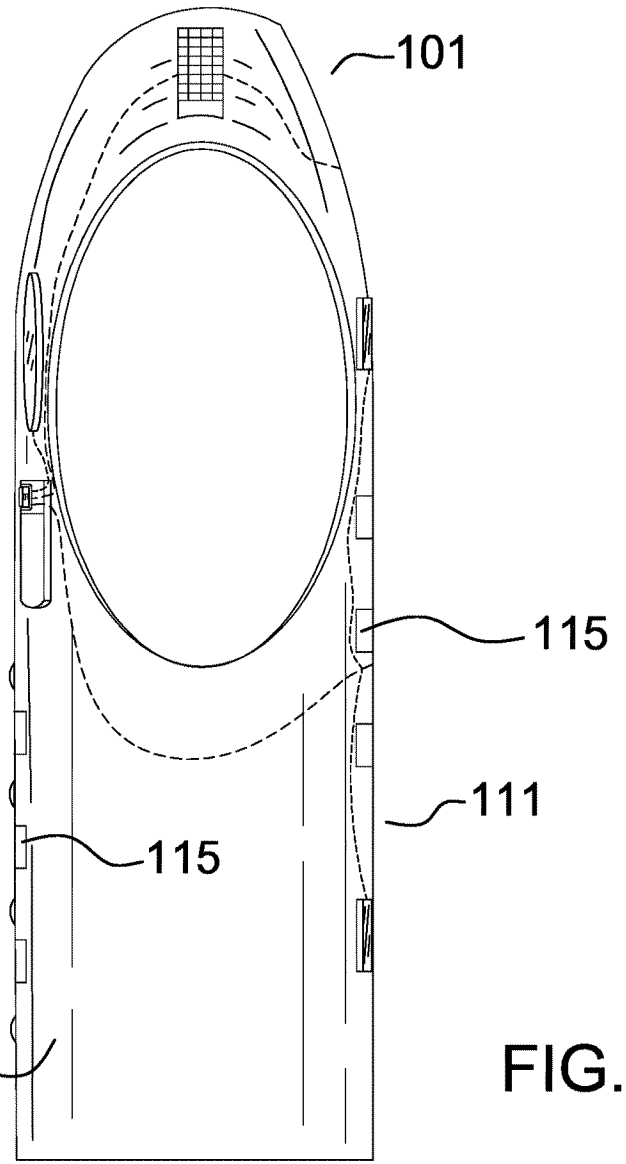
FIG. 4 is a right side view of an embodiment of the disclosure.
Figure 3:
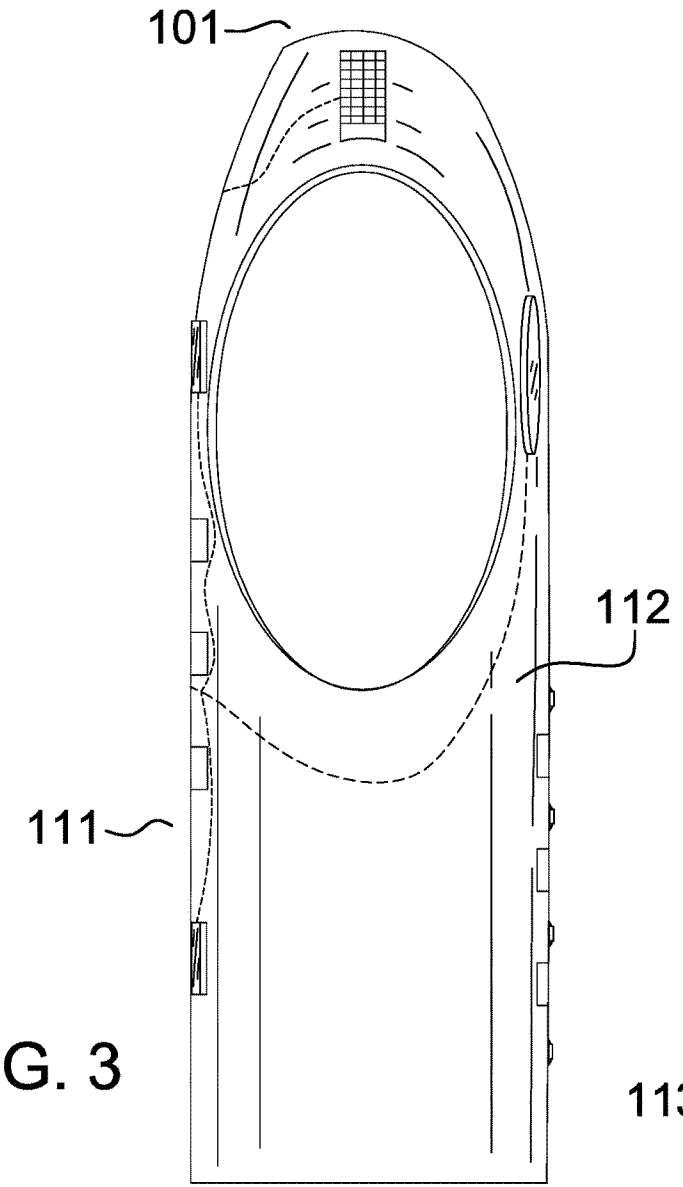
FIG. 3 is a left side view of an embodiment of the disclosure.
Figure 5:
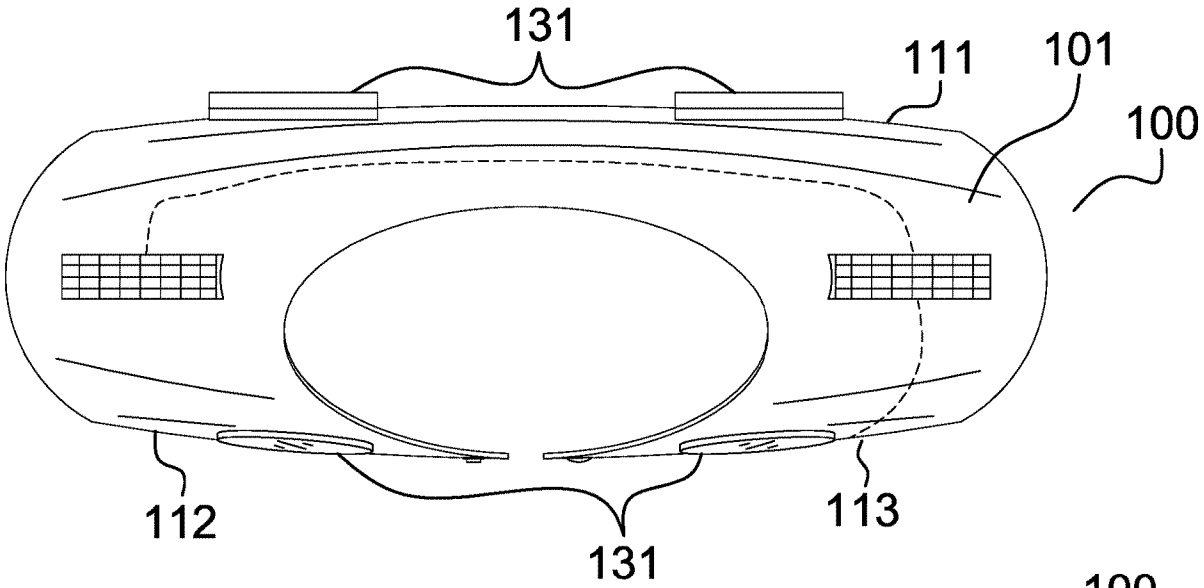
FIG. 5 is a top view of an embodiment of the disclosure.
Figure 6:
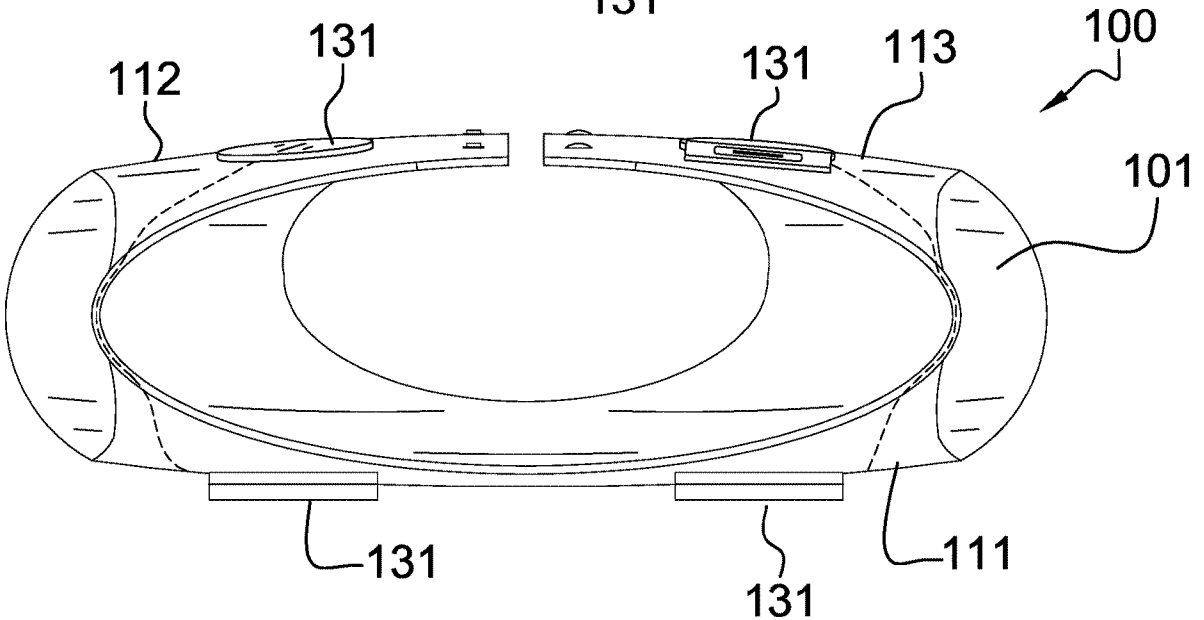
FIG. 6 is a bottom view of an embodiment of the disclosure.
Figure 7:
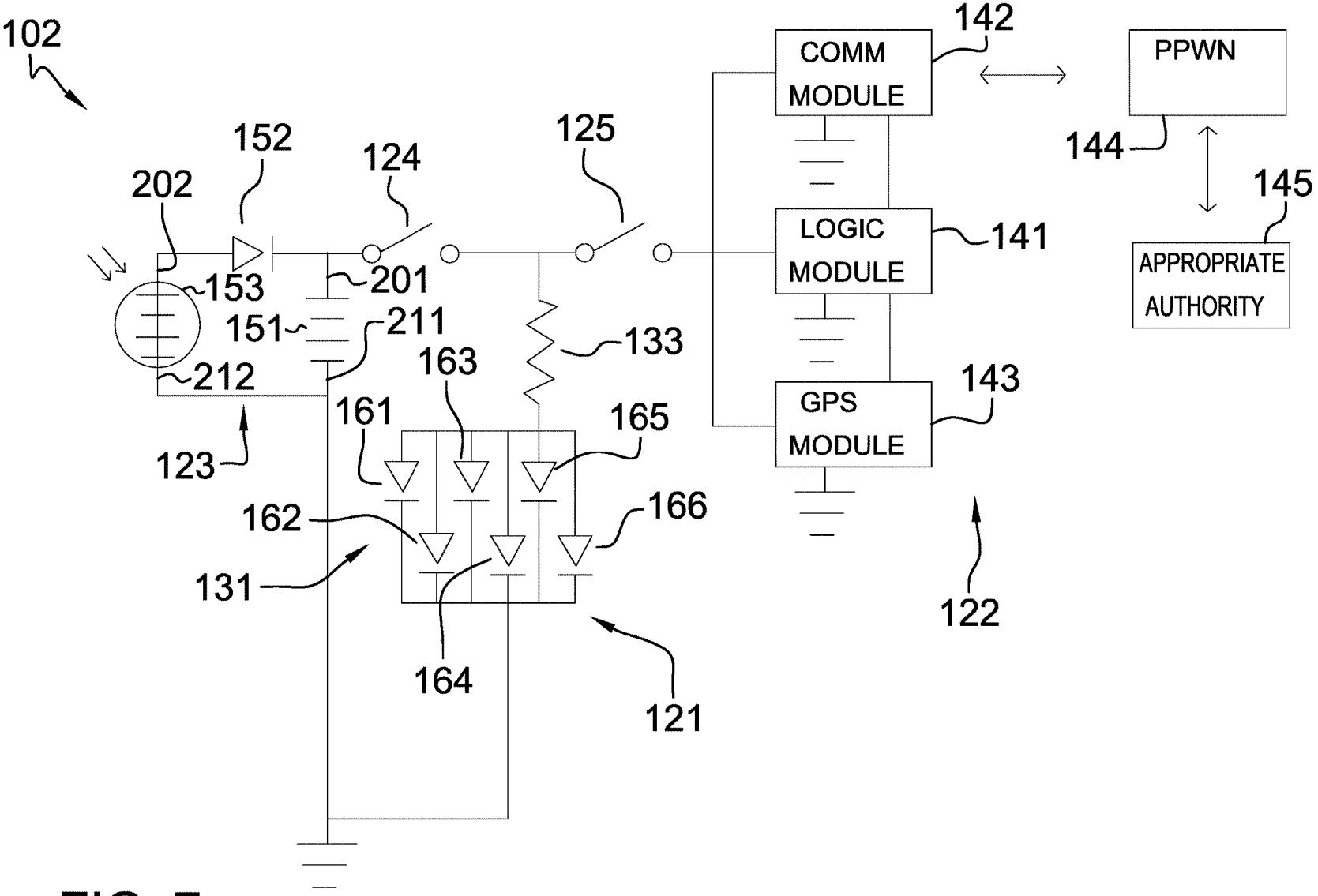
FIG. 7 is a schematic view of an embodiment of the disclosure.
Figure 8:
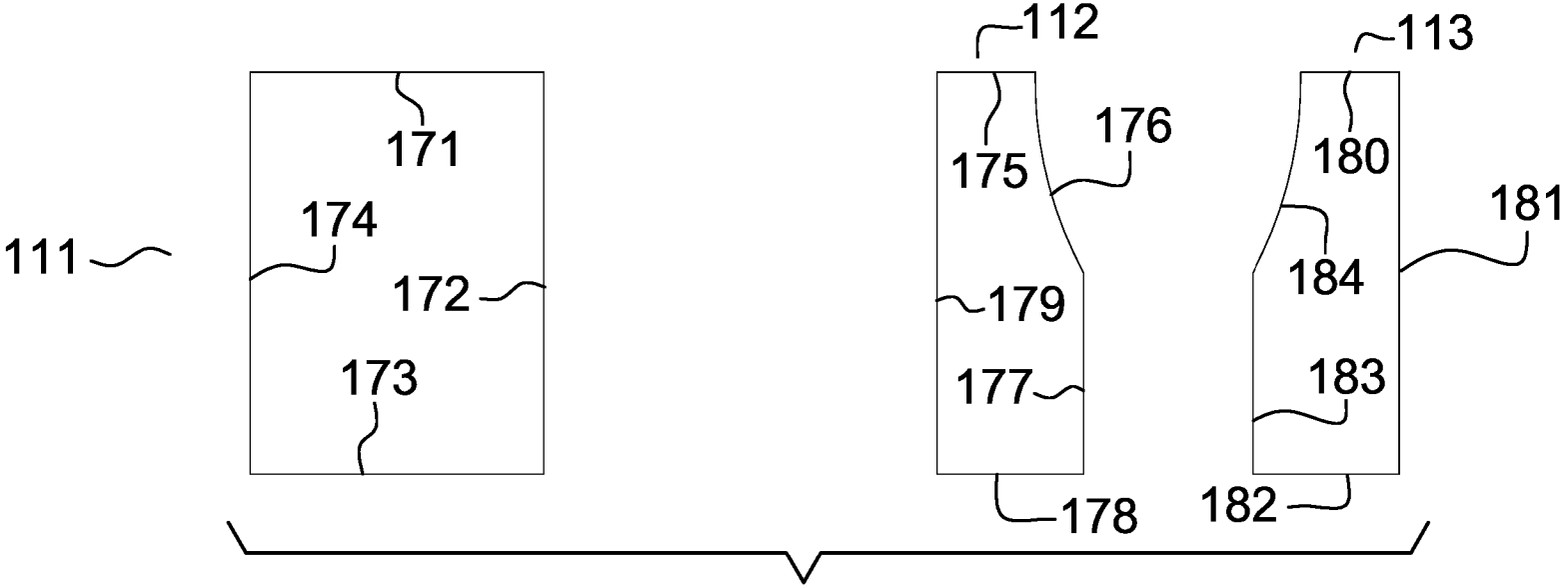
FIG. 8 is a detail view of an embodiment of the disclosure.
Figure 9:
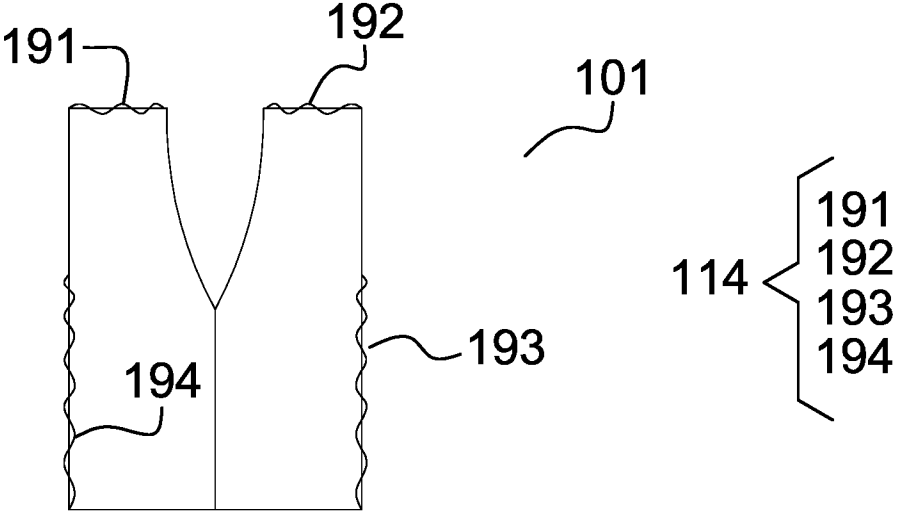
FIG. 9 is a detail view of an embodiment of the disclosure.

Detailed reference will now be made to one or more potential embodiments of the disclosure, which are illustrated in FIGS. 1 through 9.

The vest with illumination system 100 (hereinafter invention) is a garment. The invention 100 is an illuminated structure. The invention 100 is a supervised garment. By supervised garment is meant that the GPS coordinates of the invention 100 is monitored by an appropriate authority 145. The invention 100 comprises a vest 101 and a control circuit 102. The control circuit 102 installs in the vest 101. The vest 101 is worn by a client. The control circuit 102 generates the illumination of the garment. The control circuit 102 communicates the GPS coordinates of the control circuit 102 to the appropriate authority 145. The control circuit 102 is an independently powered electric circuit. By independently powered is meant that the control circuit 102 can operate without an electrical connection to an external power source.

The vest 101 is a garment. The vest 101 is worn as outerwear by a client. The control circuit 102 installs in the vest 101. The vest 101 secures the control circuit 102 to the client. The vest 101 comprises a posterior panel 111, a right anterior panel 112, a left anterior panel 113, a plurality of seams 114, and a plurality of reflectors 115.

The posterior panel 111 is a textile sheeting. The posterior panel 111 has a rectangular shape. The posterior panel 111 further comprises a first edge 171, a second edge 172, a third edge 173, and a fourth edge 174. The first edge 171 is the edge of the posterior panel 111 with the shortest span of length. The first edge 171 is a straight edge. The second edge 172 is the edge of the posterior panel 111 with the greatest span of length. The second edge 172 is a straight edge. The third edge 173 is the edge of the posterior panel 111 that is distal from the first edge 171. The third edge 173 is a straight edge. The fourth edge 174 is the edge of the posterior panel 111 that is distal from the second edge 172. The fourth edge 174 is a straight edge.

The right anterior panel 112 is a textile sheeting. The right anterior panel 112 has an irregular shape. The right anterior panel 112 is a five sided figure. The right anterior panel 112 has four straight edges. The right anterior panel 112 has one curved edge. The right anterior panel 112 attaches to the posterior panel 111. The right anterior panel 112 further comprises a fifth edge 175, a sixth edge 176, a seventh edge 177, an eighth edge 178, and a ninth edge 179.

The fifth edge 175 is the edge of the right anterior panel 112 with the shortest span of length. The right anterior panel 112 is a straight edge. The ninth edge 179 is the edge of the right anterior panel 112 with the greatest span of length. The ninth edge 179 is a straight edge. The sixth edge 176 is the edge of the right anterior panel 112 that joins the fifth edge 175 to the seventh edge 177. The sixth edge 176 is a curved edge. The seventh edge 177 is the edge of the right anterior panel 112 that joins the sixth edge 176 to the eighth edge 178. The seventh edge 177 is a straight edge. The eighth edge 178 is the edge of the right anterior panel 112 that is distal from the fifth edge 175. The eighth edge 178 is a straight edge.

The left anterior panel 113 is a textile sheeting. The left anterior panel 113 has an irregular shape. The left anterior panel 113 is a five sided figure. The left anterior panel 113 has four straight edges. The left anterior panel 113 has one curved edge. The left anterior panel 113 attaches to the posterior panel 111. The left anterior panel 113 further comprises a tenth edge 180, an eleventh edge 181, a twelfth edge 182, a thirteenth edge 183, and a fourteenth edge 184.

The tenth edge 180 is the edge of the left anterior panel 113 with the shortest span of length. The tenth edge 180 is a straight edge. The eleventh edge 181 is the edge of the left anterior panel 113 with the greatest span of length. The eleventh edge 181 is a straight edge. The fourteenth edge 184 is the edge of the left anterior panel 113 that joins the tenth edge 180 to the thirteenth edge 183. The fourteenth edge 184 is a curved edge. The thirteenth edge 183 is the edge of the left anterior panel 113 that joins the fourteenth edge 184 to the twelfth edge 182. The thirteenth edge 183 is a straight edge. The twelfth edge 182 is the edge of the left anterior panel 113 that is distal from the tenth edge 180. The twelfth edge 182 is a straight edge.

Each of the plurality of seams 114 is a seam that forms an attachment selected from the group consisting of: a) permanently attaching the right anterior panel 112 to the posterior panel 111; and, b) permanently attaching the left anterior panel 113 to the posterior panel 111. The plurality of seams 114 forms a flexible joint that allows the right anterior panel 112 to rotate relative to the posterior panel 111. The plurality of seams 114 forms a flexible joint that allows the left anterior panel 113 to rotate relative to the posterior panel 111. The plurality of seams 114 comprises a first seam 191, a second seam 192, a third seam 193, and a fourth seam 194. The plurality of seams 114 assembles the posterior panel 111, the right anterior panel 112, and the left anterior panel 113 into the garment that forms the vest 101.

The first seam 191 is a sewn seam. The second seam 192 is a sewn seam. The third seam 193 is a sewn seam. The fourth seam 194 is a sewn seam.

The first seam 191 attaches the fifth edge 175 of the right anterior panel 112 to a portion of the first edge 171 of the posterior panel 111. The first seam 191 aligns the vertex formed by the fifth edge 175 and the ninth edge 179 of the right anterior panel 112 to the vertex formed by the first edge 171 and the fourth edge 174 of the posterior panel 111.

The second seam 192 attaches the tenth edge 180 of the left anterior panel 113 to a portion of the first edge 171 of the posterior panel 111. The second seam 192 aligns the vertex formed by the tenth edge 180 and the eleventh edge 181 of the left anterior panel 113 to the vertex formed by the first edge 171 and the second edge 172 of the posterior panel 111.

The third seam 193 attaches a portion of the eleventh edge 181 of the left anterior panel 113 to a portion of the second edge 172 of the posterior panel 111. The third seam 193 aligns the vertex formed by the eleventh edge 181 and the twelfth edge 182 of the left anterior panel 113 to the vertex formed by the second edge 172 and the third edge 173 of the posterior panel 111.

The fourth seam 194 attaches a portion of the ninth edge 179 of the right anterior panel 112 to a portion of the fourth edge 174 of the posterior panel 111. The fourth seam 194 aligns the vertex formed by the eighth edge 178 and the ninth edge 179 of the right anterior panel 112 to the vertex formed by the fourth edge 174 and the third edge 173 of the posterior panel 111.

The plurality of reflectors 115 is a reflective structure. The plurality of reflectors 115 attaches to the exterior surface of a panel selected from the group consisting of: a) the posterior panel 111; b) the right anterior panel 112; and, c) the left anterior panel 113. Each reflector selected from the plurality of reflectors 115 reflects light that falls on the selected panel such that the selected reflector draws attention to the vest 101.

The control circuit 102 is an electric circuit. The control circuit 102 illuminates the space in the vicinity of the vest 101. The control circuit 102 tracks the GPS coordinates of the control circuit 102. The control circuit 102 transmits the GPS coordinates of the control circuit 102 to an appropriate authority 145. The control circuit 102 is an independently powered electric circuit. By independently powered is meant that the control circuit 102 can operate without an electrical connection to an external power source.

The control circuit 102 comprises a lamp circuit 121, a tracking circuit 122, a power circuit 123, a master switch 124, and a tracking switch 125. The lamp circuit 121, the tracking circuit 122, the power circuit 123, the master switch 124, and the tracking switch 125 are electrically connected.

The lamp circuit 121 is an electric circuit. The lamp circuit 121 generates the illumination used to illuminate the area around the vest 101. The lamp circuit 121 comprises a plurality of LED structures 131 and a limit resistor 133.

The plurality of LED structures 131 and the limit resistor 133 are electrically connected. Each of the plurality of LED structures 131 is an electric circuit. Each of the plurality of LED structures 131 comprises one or more LEDs. Each of the plurality of LED structures 131 generates an illumination when the master switch 124 is actuated into the closed position are actuated into their closed positions. The plurality of LED structures 131 comprises a first LED structure 161, a second LED structure 162, a third LED structure 163, a fourth LED structure 164, a fifth LED structure 165, and a sixth LED structure 166.

The first LED structure 161 is the structure selected from the plurality of LED structures 131 that attaches to the exterior surface of the right anterior panel 112. The second LED structure 162 is the structure selected from the plurality of LED structures 131 that attaches to the exterior surface of the left anterior panel 113.

The third LED structure 163 is the structure selected from the plurality of LED structures 131 that attaches to the exterior surface of the posterior panel 111 at a position proximal to the left anterior panel 113. The fourth LED structure 164 is the structure selected from the plurality of LED structures 131 that attaches to the exterior surface of the posterior panel 111 at a position proximal to the right anterior panel 112. The fifth LED structure 165 is the structure selected from the plurality of LED structures 131 that attaches to the exterior surface of the posterior panel 111 at a position inferior to the third LED structure 163. The sixth LED structure 166 is the structure selected from the plurality of LED structures 131 that attaches to the exterior surface of the posterior panel 111 at a position inferior to the fourth LED structure 164.

The limit resistor 133 is an electrical device. The limit resistor 133 is a resistive circuit element. The limit resistor 133 is electrically connected in series with the plurality of LED structures 131. The limit resistor 133 limits the flow of electric current through the plurality of LED structures 131.

The tracking circuit 122 is an electric circuit. The tracking circuit 122 determines the GPS coordinates of the tracking circuit 122. The tracking circuit 122 transmits the GPS coordinates of the tracking circuit 122 to the appropriate authority 145 using a commercially provided and publicly available cellular wireless network 144. The tracking circuit 122 comprises a logic module 141, a communication module 142, a GPS module 143, a commercially provided and publicly available cellular wireless network 144, and the appropriate authority 145. The communication module 142 further comprises a wireless communication link 146. The logic module 141, the communication module 142, and the GPS module 143 are electrically connected. The wireless communication link 146 forms a communication link between the communication module 142 and the commercially provided and publicly available cellular wireless network 144. The commercially provided and publicly available cellular wireless network 144 forms a communication link between the tracking circuit 122 and the appropriate authority 145.

The logic module 141 is a readily and commercially available programmable electronic device that is used to manage, regulate, and operate the control circuit 102. Depending on the specific design and the selected components, the logic module 141 can be a separate component within the control circuit 102 or the functions of the logic module 141 can be incorporated into another component within the control circuit 102. The communication module 142 is a wireless electronic communication device that allows the logic module 141 to wirelessly communicate with an appropriate authority 145. Specifically, the communication module 142 establishes a wireless communication link 146 between the control circuit 102 and a commercially provided and publicly available cellular wireless network 144.

The communication module 142 communicates SMS and MMS messages between the logic module 141 and the appropriate authority 145 through a commercially provided and publicly available cellular wireless network 144. The use of a commercially provided and publicly available cellular wireless network 144 is preferred because: 1) of its low cost; 2) of the widespread availability and the broad interoperability between competing commercially provided and publicly available cellular wireless networks 144; and, 3) methods and techniques to send SMS and MMS messages over a commercially provided and publicly available cellular wireless network 144 are well known and documented by those skilled in the electrical arts.

The GPS module 143 is an electrical device that communicates with the GPS to determine the GPS coordinates of the GPS module 143. When queried by the logic module 141, the GPS module 143 transfers the GPS coordinates to the logic module 141. The logic module 141 then transmits the GPS coordinates to the appropriate authority 145 through the communication module 142 and the commercially provided and publicly available cellular wireless network 144.

The power circuit 123 is an electrical circuit. The power circuit 123 powers the operation of the control circuit 102. The power circuit 123 is an electrochemical device. The power circuit 123 converts chemical potential energy into the electrical energy required to power the control circuit 102. The power circuit 123 comprises a battery 151, a diode 152, and a photovoltaic cell 153. The battery 151, the diode 152, and the photovoltaic cell 153 are electrically interconnected. The battery 151 comprises a first positive terminal 201 and a first negative terminal 211. The diode 152 comprises a second positive terminal 202 and a second negative terminal 212.

The master switch 124 is a maintained electric switch. The master switch 124 controls the flow of electricity from the power circuit 123 to the lamp circuit 121. The actuation of the master switch 124 to the closed position illuminates the lamp circuit 121. The actuation of the master switch 124 to the open position extinguishes the illumination of the lamp circuit 121. The master switch 124 controls the flow of electricity from the power circuit 123 to the tracking switch 125. The actuation of the master switch 124 to the closed position enables the operation of the tracking circuit 122. The actuation of the master switch 124 to the open position disables the operation of the tracking circuit 122.

The tracking switch 125 is a maintained electric switch. The tracking switch 125 controls the flow of electricity from the power circuit 123 to the tracking circuit 122. When the master switch 124 is actuated in the open position, the actuation of the tracking switch 125 is placed in a non-operational state. When the master switch 124 is actuated to the closed position: a) the actuation of the tracking switch 125 to the closed position initiates the operation of the tracking circuit 122; and, b) the actuation of the tracking switch 125 to the open position discontinues the operation of the tracking circuit 122.

The battery 151 is an electrochemical device. The battery 151 converts chemical potential energy into the electrical energy used to power the control circuit 102. The battery 151 is a commercially available rechargeable battery 151. The photovoltaic cell 153 is an electrical device that converts light into electrical energy. The chemical energy stored within the rechargeable battery 151 is further renewed and restored through the use of the photovoltaic cell 153. The photovoltaic cell 153 is directly wired to the battery 151. The photovoltaic cell 153 is an electrical circuit that reverses the polarity of the rechargeable battery 151 and provides the energy necessary to reverse the chemical processes that the rechargeable battery 151 initially used to generate the electrical energy. This reversal of the chemical process creates a chemical potential energy that will later be used by the rechargeable battery 151 to generate electricity.

The diode 152 is an electrical device that allows current to flow in only one direction. The diode 152 installs between the rechargeable battery 151 and the photovoltaic cell 153 such that electricity will not flow from the first positive terminal 201 of the rechargeable battery 151 into the second positive terminal 202 of the photovoltaic cell 153. The photovoltaic cell 153 is defined elsewhere in this disclosure.

The following definitions were used in this disclosure:

Anterior: As used in this disclosure, anterior is a term that is used to refer to the front side or direction of a structure. When comparing two objects, the anterior object is the object that is closer to the front of the structure.

Appropriate Authority: As used in this disclosure, an appropriate authority is a previously determined person or organization that is designated to send and receive alarm or other notification messages regarding a monitored system or activity.

Battery: As used in this disclosure, a battery is a chemical device consisting of one or more cells, in which chemical energy is converted into electricity and used as a source of power. Batteries are commonly defined with a positive terminal and a negative terminal.

Client: As used in this disclosure, a client is an individual who is designated to receive the services of the disclosure at bar.

Clockwise: As used in this disclosure, clockwise refers to a direction of rotation as it appears to a viewer. The clockwise direction is defined as the rotational direction that is opposite to the counterclockwise direction.

Commercially Provided And Publicly Available Cellular Wireless Network: As used in this disclosure, a commercially provided and publicly available cellular wireless network refers to subscription based publically available wireless network commonly used to provide wireless communication access for personal data devices. The commercially provided and publicly available cellular wireless network will typically provide voice communication, data communication services, and SMS and MMS messaging services. The commercially provided and publicly available cellular wireless network is commonly referred to as the cellular network. The commercially provided and publicly available cellular wireless network is abbreviated as the PPWN. See subscription.

Communication Link: As used in this disclosure, a communication link refers to the structured exchange of data between two objects.

Control Circuit: As used in this disclosure, a control circuit is an electrical circuit that manages and regulates the behavior or operation of a device.

Coronal Plane: As used in this disclosure, the coronal plane refers to a reference plane that bisects an anterior surface and posterior surface. The coronal plane is also referred to as the lateral plane.

Counterclockwise: As used in this disclosure, counterclockwise refers to a direction of rotation as it appears to a viewer. The counterclockwise direction is defined using a right hand rule. Specifically, when the viewer: 1) puts their right hand between the rotating object and themselves; and, 2) from this position points the thumb of their right hand directly at themselves; then, 3) when the viewer rotates their wrist, the fingers of the right hand will rotate in the counterclockwise direction.

Diode: As used in this disclosure, a diode is a two terminal semiconductor device that allows current flow in only one direction. The two terminals are called the anode and the cathode. Electric current is allowed to pass from the anode to the cathode.

Distal: As used in this disclosure, distal refers to a directional sense or location of the body. Specifically, distal refers to a first object or a side of a first object that is distal from the medial axis or more proximal to from the side of the body relative to a second object or side of a second object.

Electric Circuit: As used in this disclosure, an electric circuit is a closed loop path through which electrons flow. The closed loop will generally initiate and terminate at an electrical power source.

External Power Source: As used in this disclosure, an external power source is a source of the energy that is externally provided to enable the operation of the present disclosure. Examples of external power sources include, but are not limited to, electrical power sources and compressed air sources.

Garment: As used in this disclosure, a garment is a textile based structure that is used to cover an individual. Clothes, clothing, and apparel are synonyms for garment.

GPS: As used in this disclosure, and depending on the context, GPS refers to: 1) a system of navigational satellites that are used to determine the position, known as GPS coordinates, and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System. Methods to determine the distance and direction between any two sets of GPS coordinates are well-known and documented in the navigational arts.

Inferior: As used in this disclosure, inferior refers to a directional sense or location of the body. Specifically, inferior refers to an object or a side of an object that is proximal to the feet or distal from the head of the body.

Lateral: As used in this disclosure, lateral refers to a directional sense or location of the body. Specifically, lateral refers to an object or a side of an object that is proximal to the side or that is distal from the medial axis of the body.

LED: As used in this disclosure, an LED is an acronym for a light emitting diode. A light emitting diode is a diode that is also a light source.

Left and Right: As used in this disclosure, the terms left and right are directional references associated with an object that can further be defined with an anterior structure or surface and a sagittal plane. The term left refers to the side of the sagittal plane that is pointed to by the counterclockwise direction when viewed from the anterior structure. The term right refers to refers to the side of the sagittal plane that opposite to the left direction, or is in the clockwise direction when viewed from the anterior structure. Alternately, when the anterior surface of the object faces the north direction, the term left refers to the west side of the sagittal plane and the term right refers to the west side of the sagittal plane.

Limit Resistor: As used in this disclosure, a limit resistor is an electrical resistor that is used to limit the flow of electric current through an electrical circuit.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Medial: As used in this disclosure, medial refers to a directional sense or location of the body. Specifically, medial refers to a first object or a side of a first object that is closer to the medial axis or more distal from the side of the body relative to a second object or side of a second object.

Medial Axis: As used in this disclosure, the medial axis is the center line of the body as the line is drawn from the head to the foot. When two objects are compared relative to the medial axis, the object closer to the medial axis is referred to as the medial object and the object distal from the medial axis is referred to as the lateral object.

Parallel Circuit: As used in this disclosure, a parallel circuit refers to a method of electrically connecting a plurality of circuit elements to a voltage source. In a parallel circuit each circuit element receives a voltage equal to the full voltage produced by the voltage source.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photovoltaic Cell: As used in this disclosure, a photovoltaic cell is a photoelectric device that directly converts light energy into electrical energy.

Posterior: As used in this disclosure, posterior is a term that is used to refer to the side of an object that is distal or in the opposite direction of the anterior side. When comparing two items, the posterior item is the item that is distal from the anterior of the object.

PPWN: As used in this disclosure, the PPWN is an acronym for publically provided wireless network. The PPWN refers to a commercially provided and publicly available cellular wireless network.

Reflection: As used in this disclosure, reflection refers to the change in the direction of a wave as the wave hits the boundary between two media. The direction of the reflected wave remains within the media through which the wave traveled to reach the boundary. See refraction Reflector: As used in this disclosure, a reflector is a device that is used to change the direction of a wave.

Reflectors can be used to focus the reflected wave towards a single point.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Sagittal Plane: As used in this disclosure, the sagittal plane refers to a plane that is perpendicular to both the coronal (or lateral) plane and the transverse plane.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Series Circuit: As used in this disclosure, a series circuit refers to a method of electrically connecting a plurality of circuit elements to a voltage source. In a series circuit, the proportion of the voltage received by each individual circuit element is divided proportionally between the plurality circuit elements based on the resistance (or impedance) of each circuit element relative to the total resistance of the plurality of circuit elements. The series circuit forms a linear or loop structure often referred to as a daisy chain.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

SMS: As used in this disclosure, SMS is an abbreviation for short message service. The short message service is a service that is often provided with the cellular services that support personal data devices. Specifically, the SMS allows for the exchange of written messages between personal data devices. The SMS is commonly referred to as text messaging. A common enhancement of SMS is the inclusion of the delivery of multimedia services. This enhanced service is often referred to as Multimedia Media Services which is abbreviated as MMS.

Superior: As used in this disclosure, superior refers to a directional sense or location of the body. Specifically, superior refers to an object or a side of an object that is distal from the feet or proximal to the head of the body.

Supervisory: As used in this disclosure, supervisory describes a relationship between a first object and a second object wherein the function of the first object is limited to monitoring the actions or activity of the second object. The first object is said to supervise the second object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Textile: As used in this disclosure, a textile is a material that is woven, knitted, braided or felted. Synonyms in common usage for this definition include fabric and cloth. The two surfaces of the textile with the greatest surface area are called the faces of the textile.

Transverse Plane: As used in this disclosure, a transverse plane is a plane that divides an object into a superior section and an inferior section. In a person the transverse plane would be perpendicular to the medial axis of a body. See Superior Vest: As used in this disclosure, a vest is a sleeveless waist to hip length garment that is worn over the torso.

Wireless: As used in this disclosure, wireless is an adjective that is used to describe a communication channel between two devices that does not require the use of physical cabling.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An illuminating vest comprising
a vest and a control circuit;
wherein the control circuit installs in the vest;
wherein the vest is a garment;
wherein the illuminating vest is an illuminated structure;
wherein the illuminating vest is a supervised garment;
wherein by supervised garment is meant that the GPS coordinates of the illuminating vest is monitored by an appropriate authority;
wherein the control circuit generates the illumination of the garment;
wherein the control circuit communicates the GPS coordinates of the control circuit to the appropriate authority;
wherein the control circuit is an independently powered electric circuit;
wherein by independently powered is meant that the control circuit can operate without an electrical connection to an external power source;
wherein the control circuit is an electric circuit;
wherein the control circuit illuminates the space in the vicinity of the vest;
wherein the control circuit tracks the GPS coordinates of the control circuit;
wherein the control circuit transmits the GPS coordinates of the control circuit to the appropriate authority;
wherein the vest comprises a posterior panel, a right anterior panel, a left anterior panel, a plurality of seams, and a plurality of reflectors;
wherein the plurality of seams assembles the posterior panel, the right anterior panel, and the left anterior panel into the garment that forms the vest;
wherein each of the plurality of seams is a seam that forms an attachment selected from the group consisting of: a) permanently attaching the right anterior panel to the posterior panel; and, b) permanently attaching the left anterior panel to the posterior panel;
wherein the plurality of reflectors is a reflective structure;
wherein the plurality of reflectors attaches to the exterior surface of a panel selected from the group consisting of: a) the posterior panel; b) the right anterior panel; and, c) the left anterior panel;
wherein the control circuit comprises a lamp circuit, a tracking circuit, a power circuit, a master switch, and a tracking switch;
wherein the lamp circuit, the tracking circuit, the power circuit, the master switch, and the tracking switch are electrically connected;
wherein the lamp circuit comprises a plurality of LED structures and a limit resistor;
wherein the plurality of LED structures and the limit resistor are electrically connected;
wherein the tracking circuit comprises a logic module, a communication module, a GPS module, a commercially provided and publicly available cellular wireless network, and the appropriate authority;
wherein the communication module further comprises a wireless communication link;
wherein the logic module, the communication module, and the GPS module are electrically connected;
wherein the wireless communication link forms a communication link between the communication module and the commercially provided and publicly available cellular wireless network;
wherein the commercially provided and publicly available cellular wireless network forms a communication link between the tracking circuit and the appropriate authority;
wherein the power circuit comprises a battery, a diode, and a photovoltaic cell;
wherein the battery, the diode, and the photovoltaic cell are electrically interconnected;
wherein the battery comprises a first positive terminal and a first negative terminal;
wherein the diode comprises a second positive terminal and a second negative terminal.

2. The illuminating vest according to claim 1
wherein the lamp circuit is an electric circuit;
wherein the lamp circuit generates the illumination used to illuminate the area around the vest;
wherein each of the plurality of LED structures is an electric circuit;
wherein each of the plurality of LED structures comprises one or more LEDs;
wherein each of the plurality of LED structures generates an illumination when the master switch is actuated into the closed position are actuated into their closed positions;
wherein the limit resistor is an electrical device;
wherein the limit resistor is a resistive circuit element;
wherein the limit resistor is electrically connected in series with the plurality of LED structures;
wherein the limit resistor limits the flow of electric current through the plurality of LED structures;
wherein the tracking circuit is an electric circuit;
wherein the tracking circuit determines the GPS coordinates of the tracking circuit;
wherein the tracking circuit transmits the GPS coordinates of the tracking circuit to the appropriate authority using a commercially provided and publicly available cellular wireless network;
wherein the power circuit is an electrical circuit;
wherein the power circuit powers the operation of the control circuit;
wherein the power circuit is an electrochemical device;
wherein the master switch is a maintained electric switch;
wherein the tracking switch is a maintained electric switch.

3. The illuminating vest according to claim 2
wherein the plurality of seams forms a flexible joint that allows the right anterior panel to rotate relative to the posterior panel;
wherein the plurality of seams forms a flexible joint that allows the left anterior panel to rotate relative to the posterior panel.

4. The illuminating vest according to claim 3
wherein the posterior panel is a textile sheeting;
wherein the posterior panel has a rectangular shape.

5. The illuminating vest according to claim 4
wherein the right anterior panel is a textile sheeting;
wherein the right anterior panel has an irregular shape;
wherein the right anterior panel is a five sided figure;
wherein the right anterior panel has four straight edges;
wherein the right anterior panel has one curved edge;
wherein the right anterior panel attaches to the posterior panel.

6. The illuminating vest according to claim 5
wherein the left anterior panel is a textile sheeting;
wherein the left anterior panel has an irregular shape;
wherein the left anterior panel is a five sided figure;
wherein the left anterior panel has four straight edges;
wherein the left anterior panel has one curved edge;
wherein the left anterior panel attaches to the posterior panel.

7. The illuminating vest according to claim 6
wherein the plurality of LED structures comprises a first LED structure, a second LED structure, a third LED structure, a fourth LED structure, a fifth LED structure, and a sixth LED structure;
wherein the first LED structure is the structure selected from the plurality of LED structures that attaches to the exterior surface of the right anterior panel;
wherein the second LED structure is the structure selected from the plurality of LED structures that attaches to the exterior surface of the left anterior panel;
wherein the third LED structure is the structure selected from the plurality of LED structures that attaches to the exterior surface of the posterior panel at a position proximal to the left anterior panel;
wherein the fourth LED structure is the structure selected from the plurality of LED structures that attaches to the exterior surface of the posterior panel at a position proximal to the right anterior panel;
wherein the fifth LED structure is the structure selected from the plurality of LED structures that attaches to the exterior surface of the posterior panel at a position inferior to the third LED structure;
wherein the sixth LED structure is the structure selected from the plurality of LED structures that attaches to the exterior surface of the posterior panel at a position inferior to the fourth LED structure.

8. The illuminating vest according to claim 7
wherein the logic module is a programmable electronic;
wherein the communication module is a wireless electronic communication device that allows the logic module to wirelessly communicate with an appropriate authority;
wherein the communication module establishes a wireless communication link between the control circuit and a commercially provided and publicly available cellular wireless network;
wherein the communication module communicates SMS and MMS messages between the logic module and the appropriate authority through a commercially provided and publicly available cellular wireless network.

9. The illuminating vest according to claim 8
wherein the GPS module is an electrical device that communicates with the GPS to determine the GPS coordinates of the GPS module;
wherein when queried by the logic module, the GPS module transfers the GPS coordinates to the logic module;
wherein the logic module then transmits the GPS coordinates to the appropriate authority through the communication module and the commercially provided and publicly available cellular wireless network.

10. The illuminating vest according to claim 9
wherein the master switch controls the flow of electricity from the power circuit to the lamp circuit;
wherein the actuation of the master switch to the closed position illuminates the lamp circuit;
wherein the actuation of the master switch to the open position extinguishes the illumination of the lamp circuit;
wherein the master switch controls the flow of electricity from the power circuit to the tracking switch;
wherein the actuation of the master switch to the closed position enables the operation of the tracking circuit;
wherein the actuation of the master switch to the open position disables the operation of the tracking circuit;
wherein when the master switch is actuated in the open position, the actuation of the tracking switch is placed in a non-operational state;
wherein when the master switch is actuated to the closed position: a) the actuation of the tracking switch to the closed position initiates the operation of the tracking circuit; and, b) the actuation of the tracking switch to the open position discontinues the operation of the tracking circuit.

11. The illuminating vest according to claim 10
wherein the battery is a rechargeable battery;
wherein the photovoltaic cell is an electrical device that converts light into electrical energy;
wherein the photovoltaic cell is directly wired to the battery;
wherein the photovoltaic cell is an electrical circuit that reverses the polarity of the rechargeable.

12. The illuminating vest according to claim 11
wherein the diode is an electrical device that allows current to flow in only one direction;
wherein the diode installs between the rechargeable battery and the photovoltaic cell such that electricity will not flow from the first positive terminal of the rechargeable battery into the second positive terminal of the photovoltaic cell.

13. The illuminating vest according to claim 12
wherein the posterior panel further comprises a first edge, a second edge, a third edge, and a fourth edge;
wherein the first edge is the edge of the posterior panel with the shortest span of length;
wherein the first edge is a straight edge;
wherein the second edge is the edge of the posterior panel with the greatest span of length;
wherein the second edge is a straight edge;
wherein the third edge is the edge of the posterior panel that is distal from the first edge;
wherein the third edge is a straight edge;
wherein the fourth edge is the edge of the posterior panel that is distal from the second edge;
wherein the fourth edge is a straight edge.

14. The illuminating vest according to claim 13
wherein the right anterior panel further comprises a fifth edge, a sixth edge, a seventh edge, an eighth edge, and a ninth edge;
wherein the fifth edge is the edge of the right anterior panel with the shortest span of length;
wherein the right anterior panel is a straight edge;
wherein the ninth edge is the edge of the right anterior panel with the greatest span of length;

wherein the ninth edge is a straight edge;
wherein the sixth edge is the edge of the right anterior panel that joins the fifth edge to the seventh edge;
wherein the sixth edge is a curved edge;
wherein the seventh edge is the edge of the right anterior panel that joins the sixth edge to the eighth edge;
wherein the seventh edge is a straight edge;
wherein the eighth edge is the edge of the right anterior panel that is distal from the fifth edge;
wherein the eighth edge is a straight edge.

15. The illuminating vest according to claim 14
wherein the left anterior panel further comprises a tenth edge, an eleventh edge, a twelfth edge, a thirteenth edge, and a fourteenth edge;
wherein the tenth edge is the edge of the left anterior panel with the shortest span of length;
wherein the tenth edge is a straight edge;
wherein the eleventh edge is the edge of the left anterior panel with the greatest span of length;
wherein the eleventh edge is a straight edge;
wherein the fourteenth edge is the edge of the left anterior panel that joins the tenth edge to the thirteenth edge;
wherein the fourteenth edge is a curved edge;
wherein the thirteenth edge is the edge of the left anterior panel that joins the fourteenth edge to the twelfth edge;
wherein the thirteenth edge is a straight edge;
wherein the twelfth edge is the edge of the left anterior panel that is distal from the tenth edge;
wherein the twelfth edge is a straight edge.

16. The illuminating vest according to claim 15
wherein the plurality of seams comprises a first seam, a second seam, a third seam, and a fourth seam;
wherein the first seam is a sewn seam;
wherein the second seam is a sewn seam;
wherein the third seam is a sewn seam;
wherein the fourth seam is a sewn seam;
wherein the first seam attaches the fifth edge of the right anterior panel to a portion of the first edge of the posterior panel;
wherein the first seam aligns the vertex formed by the fifth edge and the ninth edge of the right anterior panel to the vertex formed by the first edge and the fourth edge of the posterior panel;
wherein the second seam attaches the tenth edge of the left anterior panel to a portion of the first edge of the posterior panel;
wherein the second seam aligns the vertex formed by the tenth edge and the eleventh edge of the left anterior panel to the vertex formed by the first edge and the second edge of the posterior panel;
wherein the third seam attaches a portion of the eleventh edge of the left anterior panel to a portion of the second edge of the posterior panel;
wherein the third seam aligns the vertex formed by the eleventh edge and the twelfth edge of the left anterior panel to the vertex formed by the second edge and the third edge of the posterior panel;
wherein the fourth seam attaches a portion of the ninth edge of the right anterior panel to a portion of the fourth edge of the posterior panel;
wherein the fourth seam aligns the vertex formed by the eighth edge and the ninth edge of the right anterior panel to the vertex formed by the fourth edge and the third edge of the posterior panel.

* * * * *